US007168882B1

(12) United States Patent
Owen

(10) Patent No.: US 7,168,882 B1
(45) Date of Patent: Jan. 30, 2007

(54) ROAD BARRIER

(75) Inventor: Alfred Owen, Frisco, TX (US)

(73) Assignees: A. W. Owen, Plano, TX (US); S. Owen, Plano, TX (US); J. D. Owen, Dallas, TX (US)

( * ) Notice: Subject to any disclaimer, the term of this patent is extended or adjusted under 35 U.S.C. 154(b) by 0 days.

(21) Appl. No.: 11/225,503

(22) Filed: Sep. 14, 2005

(51) Int. Cl.
*E01F 15/08* (2006.01)

(52) U.S. Cl. ..... 404/6; 256/13.1

(58) Field of Classification Search ..... 256/1
See application file for complete search history.

(56) References Cited

U.S. PATENT DOCUMENTS

| | | | | | |
|---|---|---|---|---|---|
| 2,129,503 | A * | 9/1938 | Mulieri | 404/6 |
| 2,994,255 | A * | 8/1961 | Trief et al. | 404/7 |
| 3,288,440 | A * | 11/1966 | Hendrikus et al. | 256/13.1 |
| 3,308,724 | A * | 3/1967 | Such | 404/7 |
| 3,326,099 | A * | 6/1967 | Fedele et al. | 404/7 |
| 3,591,144 | A * | 7/1971 | Iving | 404/6 |
| 4,307,973 | A * | 12/1981 | Glaesener | 404/6 |
| 4,376,594 | A * | 3/1983 | Prosenz | 404/6 |
| 4,435,106 | A * | 3/1984 | Forster et al. | 404/6 |
| 4,463,934 | A * | 8/1984 | Ochoa et al. | 256/13.1 |
| 4,502,812 | A * | 3/1985 | Zucker | 404/6 |
| 5,230,582 | A * | 7/1993 | Schmitt et al. | 404/6 |
| 5,387,049 | A * | 2/1995 | Duckett | 404/6 |
| 5,697,728 | A * | 12/1997 | Camomilla et al. | 404/6 |
| 5,746,538 | A * | 5/1998 | Gunness | 404/6 |
| 6,276,667 | B1 * | 8/2001 | Arthur | 256/13.1 |
| 6,439,802 | B1 * | 8/2002 | Duckett | 404/6 |
| 6,551,011 | B1 * | 4/2003 | Valentine | 404/6 |
| 6,551,012 | B1 * | 4/2003 | Hoebergen et al. | 404/6 |
| 6,595,715 | B1 * | 7/2003 | Cortell | 404/6 |
| 6,702,513 | B1 * | 3/2004 | Raupach | 404/6 |
| 6,840,706 | B1 * | 1/2005 | Camomilla et al. | 404/6 |

FOREIGN PATENT DOCUMENTS

| | | |
|---|---|---|
| EP | 0 575 705 | * 12/1993 |

* cited by examiner

*Primary Examiner*—Gary S. Hartmann
(74) *Attorney, Agent, or Firm*—I. Zborovsky

(57) ABSTRACT

A road barrier has a bottom part and a top part which extends upwardly and forms in the top part at least one downwardly inclined side surface so that when in a case of an accident a vehicle hits the road barrier from a side of the at least one downwardly inclined side surface, it can be thrown back into its lane.

4 Claims, 5 Drawing Sheets

ROAD BARRIER

BACKGROUND OF THE INVENTION

The present invention relates to road barriers.

Existing road barriers are used for example for separation of traffic moving in opposite direction, so as to prevent vehicles driving in one direction to enter lanes on which the vehicles move in an opposite direction, and therefore to prevent road accidents. Also, the road barriers serve for preventing blinding of drivers by illumination devices of vehicles coming from the opposite side.

In order to increase barrier properties of the existing barriers, more particularly to make them more reliable in the sense of preventing climbing of a vehicle from one movement direction over the barrier into the lanes of the opposite moving direction and to prevent blinding of drivers, higher barriers have to be utilized. In order to utilize higher barriers, all barriers have to be removed and replaced with new barriers with a greater height. This process is however exceptionally expensive not only because new barriers of a greater height have to be produced, but also because the existing barriers have to be dismounted and removed from roads, etc.

It is therefore believed that it is advisable to improve barrier characteristics of existing barriers, without removing them and replacing them with higher barriers.

SUMMARY OF THE INVENTION

According, it is an object of the present invention to provide road barrier which has an improved barrier characteristic.

In keeping with these objects and with others which will become apparent hereinafter, one feature of the present invention resides, briefly stated, in a road barrier which has a top part that extends upwardly so as to form in the top part at least one downwardly inclined surface so that when in a case of an accident a vehicle hits said at least one downwardly inclined surface of the road barrier it can be thrown back into its lane.

In accordance with another feature of the present invention, a road barrier is provided which includes a barrier element and an attachment attached to a top part of the road barrier element and having a cross-section which extends upwardly so as to provide at least one side wall which is inclined downwardly so that in a case of an accident if a vehicle hits said at least one side wall of the attachment of the the road barrier it can be thrown back into its lane.

When the road barrier is designed in accordance with the present invention, it has an increased safety feature, in preventing vehicles from entering opposite lanes by passing over the barrier. In addition, blinding of traffic participants can be increased by providing the additional attachment which increases the height of existing road barriers.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
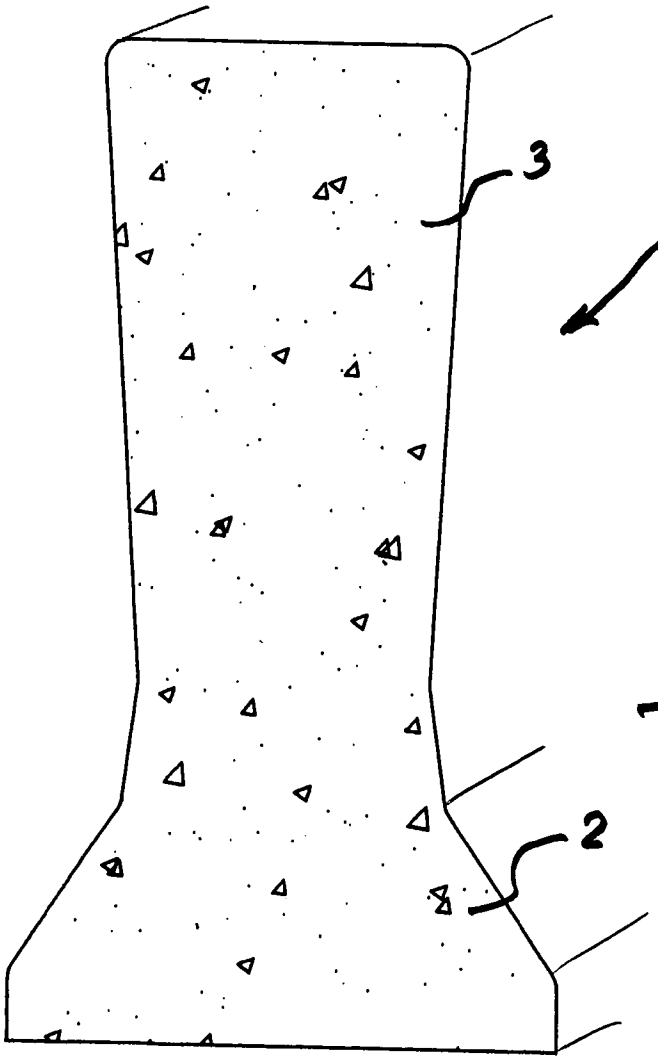
FIG. 1 is a view showing a road barrier in accordance with a first embodiment of the present invention.

FIG. 1 shows a road barrier in accordance with one embodiment of the present invention. The road barrier can be composed for example of concrete as conventional road barriers. The road barrier is identified as a whole with reference numeral 1. It has a lower part which is identified with reference numeral 2, and an upper part which is identified with reference numeral 3. As can be seen from the drawings, the upper part of the road barrier 1 extends upwardly so as to form side surfaces which are inclined downwardly at an acute angle to a road surface. When the road barrier is formed in accordance with the present invention then in a case of an accident when a vehicle hits the barrier, for example from the right side of the barrier with respect to FIG. 1, it is thrown back into its lane because it hits the downwardly inclined side surface. The vehicle therefore does not pass over the barrier to the left side into an opposite lane. This provides a very important safety improvement of the road barrier.

As shown in FIG. 1, the lower part of the road barrier extends downwardly so as to provide a wider foundation for the barrier to ensure a stable position of the road barrier on the road. The lower part of the barrier can be of course formed in a different way.

Figure 2:
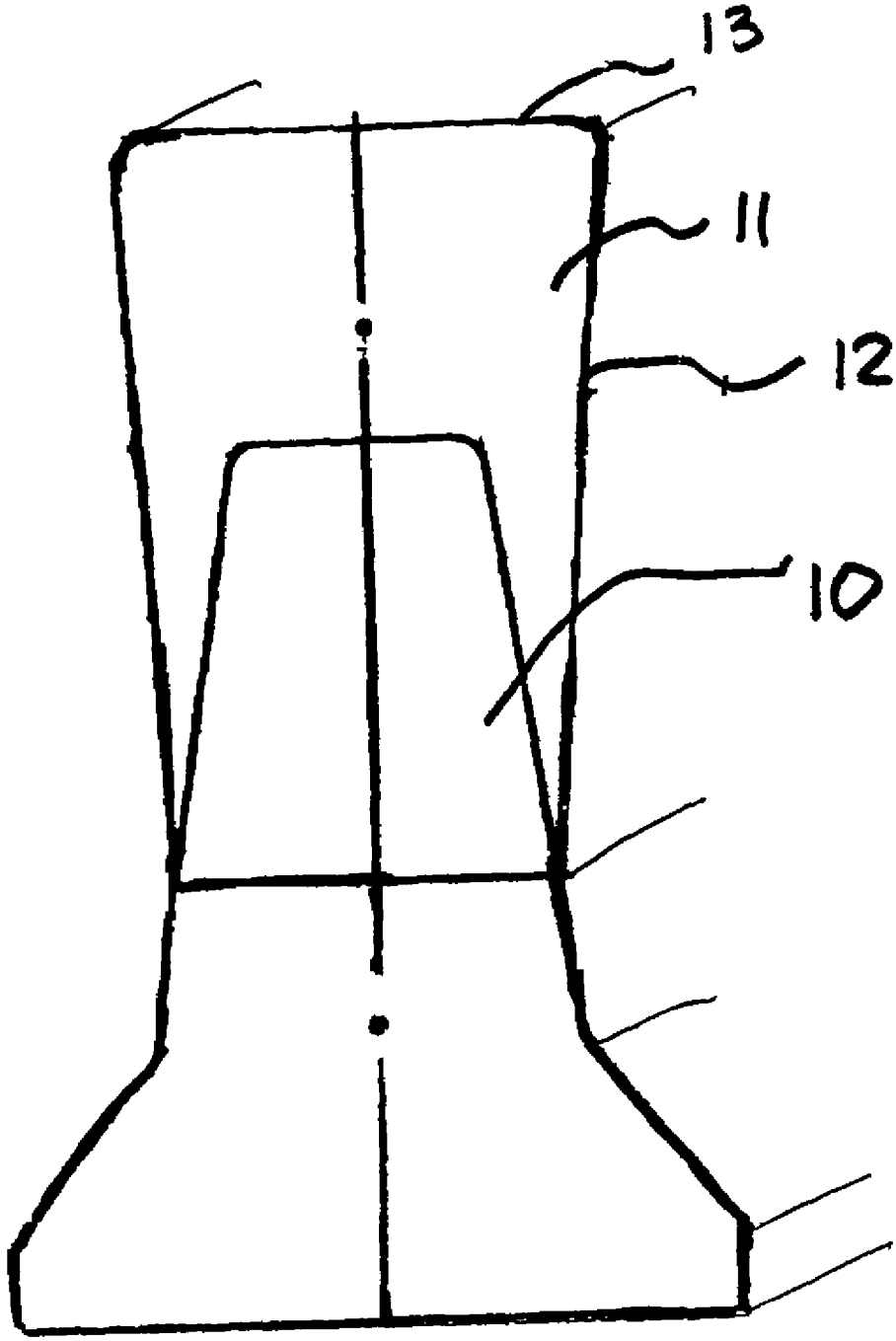
FIG. 2 is a view showing a road barrier in accordance with a second embodiment of the present invention.
Figure 3:
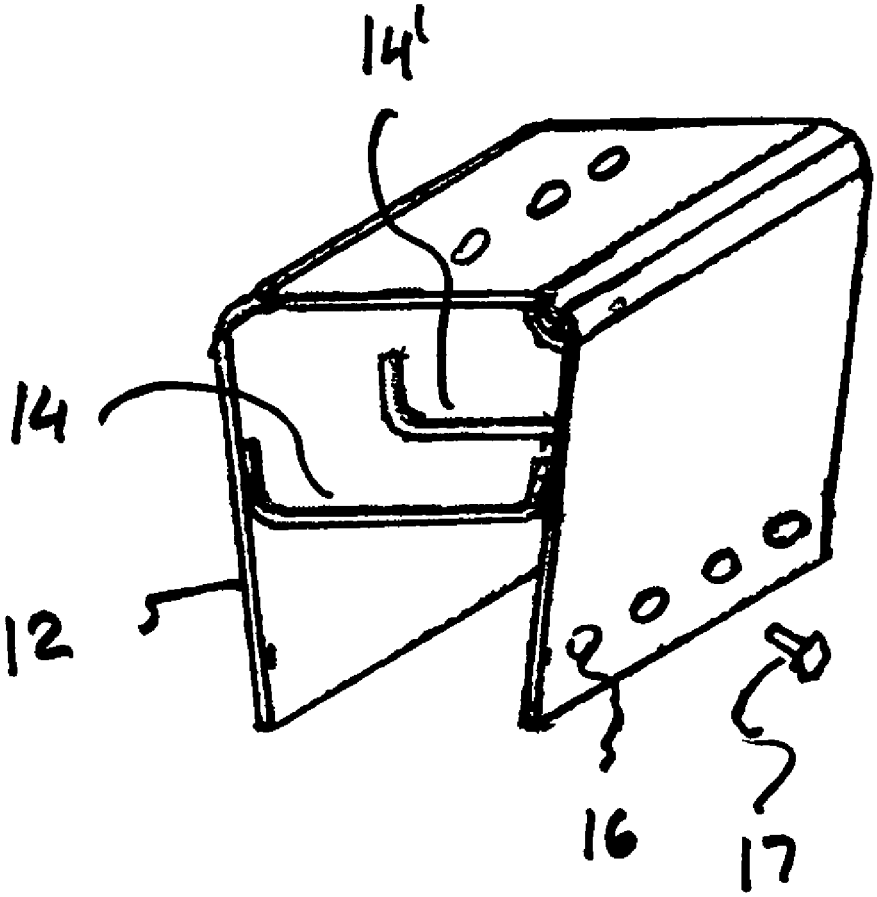
FIG. 3 is a view showing an attachment of the road barrier of FIG. 2.

A road barrier bin accordance with another embodiment of the present invention is shown in FIGS. 2–3. It has a road barrier element identified with reference numeral 10 and an attachment device which is identified as a whole with reference numeral 11. The device has two side walls identified with reference numeral 12 and spaced from one another in a horizontal direction. The device further has a top wall 13 which extends substantially horizontally between the side walls 12 and connect the side walls 12 with one another, preferably at their top ends. As shown in the drawings, the side walls 12 or at least their upper portion, can expand upwardly or in other words can extend from the top wall 13 downwardly so that they narrow downwardly to form downwardly inclined side surfaces (inclined at an acute angle), so that a distance between the side walls 12 in the area of its lower ends is smaller than the distance between the side walls 12 in the area of the top wall 13. At the same time the lower portions of the side walls 12 can extend differently, for example expand downwardly, to fit over an existing barrier.

An intermediate element identified as a whole with reference numeral 14 is located below the top wall 13 but above the lower ends of the side walls 12. The intermediate element 14 is connected to the side walls 12. The intermediate element 4 can be composed of a plurality of intermediate members 14', 14", etc which are spaced from one another in a horizontal direction, that is transverse to a horizontal direction in which the side walls 12 are spaced from one another. The intermediate members 14', 14', etc. can be formed for example as rebars which are for example welded to the inner surfaces of the side walls 12.

In accordance with the present invention, the attachment device 11 is mountable on the existing road barrier element 10 as shown in FIG. 2. For this purpose the lower parts of the side wall under the intermediate element 14 are fitted on the barrier element 10, and the intermediate element 14 is placed on a top surface of the barrier element.

The device 11 is connectable with the barrier element by connecting means. The connecting means can be formed for example as bolts 17, and the like extending through openings 16 which are formed in the lower parts of the side walls 12, so that the bolts etc. extend horizontally and are driven through the openings 16 into the side walls of the barrier element. In addition, bolts can pass through openings in a vertical direction and can be driven into the top part of the barrier element. As a result, the device 11 is reliably held on the top part of the barrier element 10.

The thusly provided barrier system includes the barrier element, and the attaching device 11 which extends upwardly beyond the upper surface of the barrier and increases the height of the barrier. As a result, the barrier characteristics are significantly improved. It is less likely that the vehicle driving at one side of the thusly formed barrier system will pass over the barrier into lanes at the opposite sides of the barrier, since the device 11 improves throwing of such a vehicle back into the lane in which it has been driving before hitting the barrier. Also, because of an increased height of the barrier system, blinding of drivers of vehicles by illumination device of vehicles moving in an opposite direction is significantly reduced or prevented.

Figure 4:
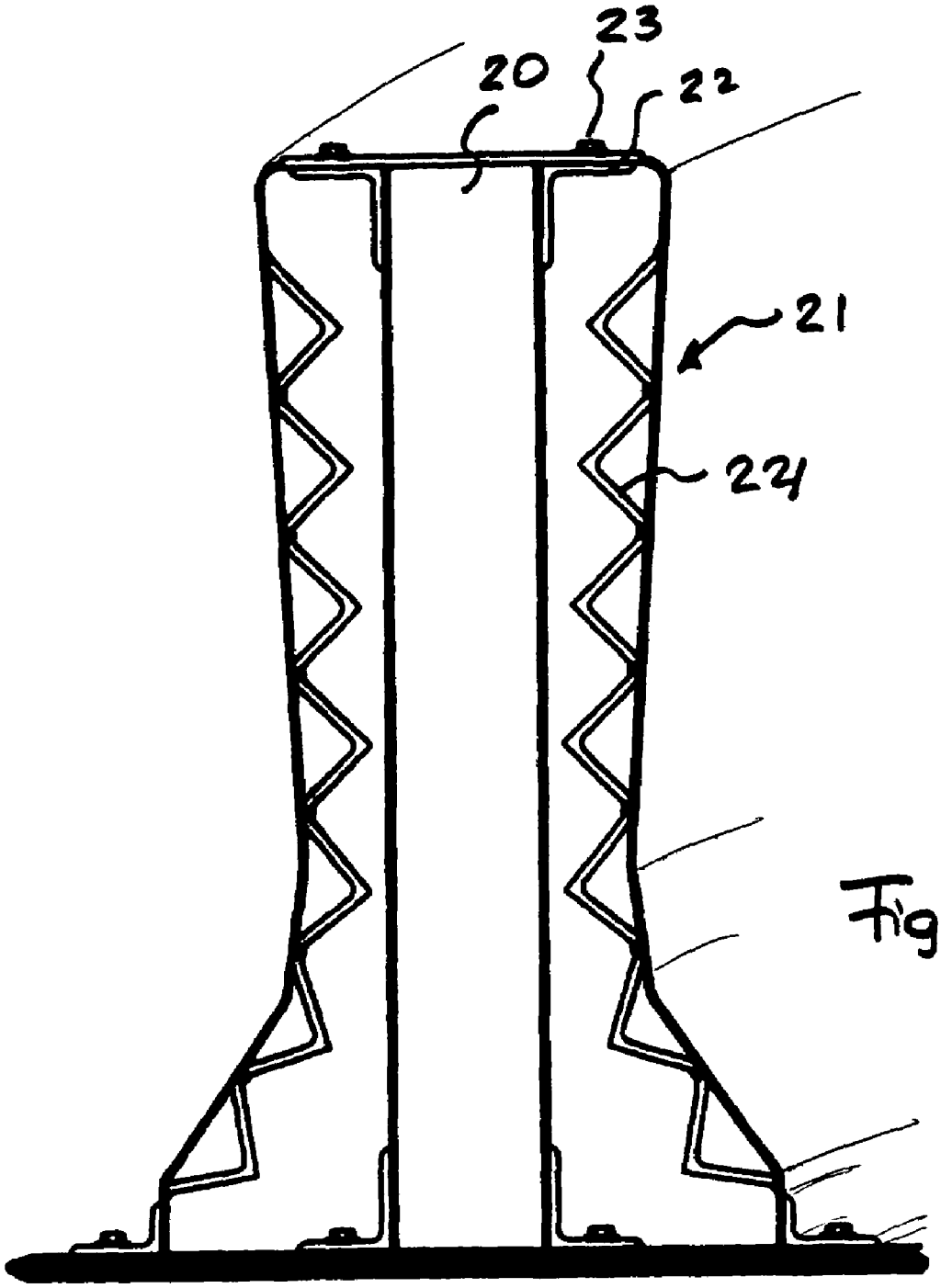
FIG. 4 is a view showing a road barrier, in accordance with a third embodiment of the present invention.

FIG. 4 shows a road barrier in accordance with another embodiment of the present invention. The road barrier has a central barrier element identified with reference numeral 20 and two side elements 21. The central road element 20 can be formed for example as an I bar having substantially H-shaped cross-section. The side elements 21 are attached to the central road element 20 for example by angles 22 and bolts 23. Each of the side elements 21 has a side surface which is inclined downwardly at an acute angle for the same reason as in the previous embodiments, to push a vehicle which hits the barrier back into its lane. Each of the side elements 21 can be provided with a reinforcing element 24, which can be formed for example as a corrugated element and attached to the side element 21 for example by welding. As can be seen the angles 22 can be welded to the central barrier element 20. The road barrier as a whole can be connected to a road surface by corresponding angles and bolts.

Figure 5:
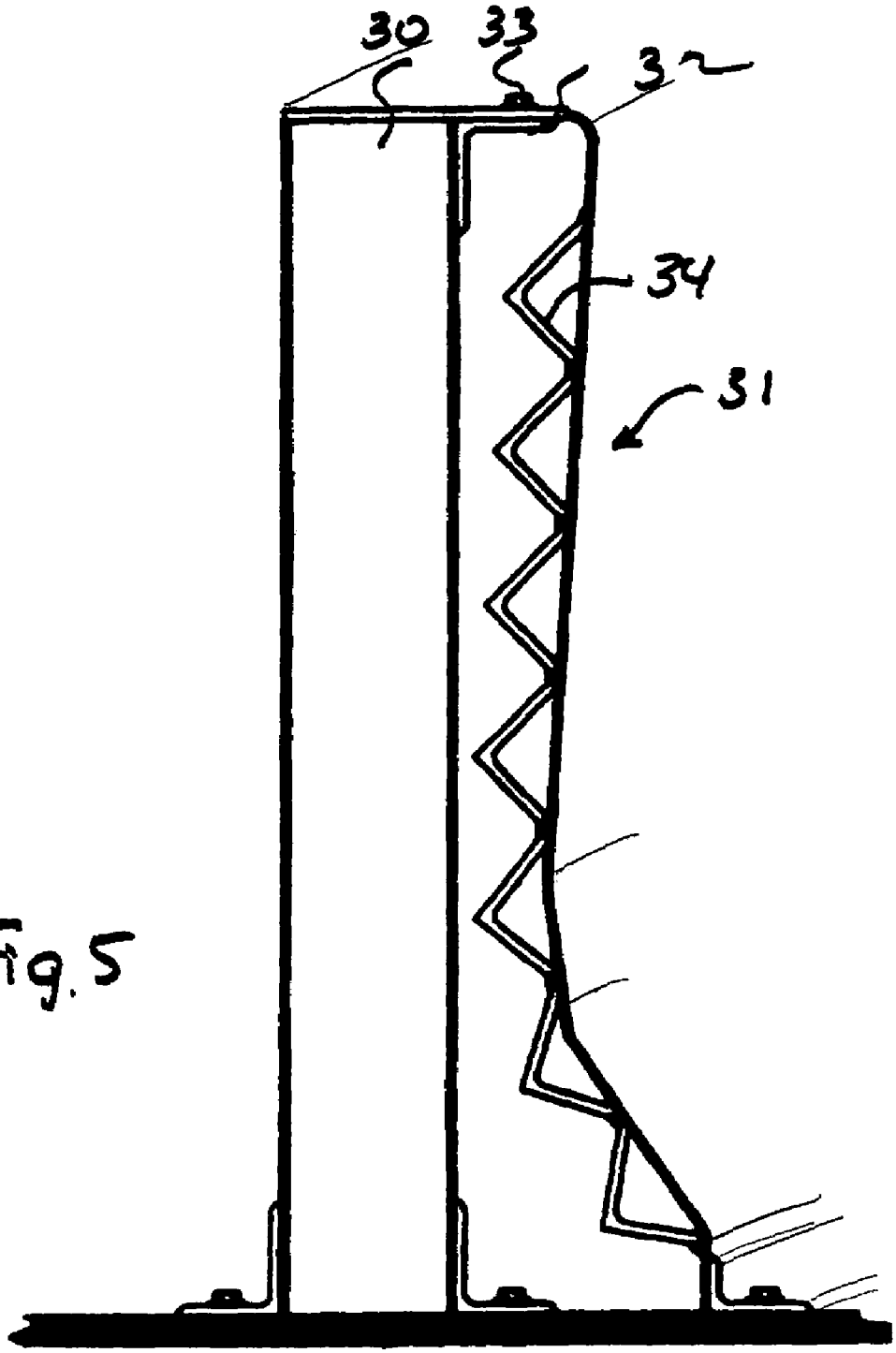
FIG. 5 is a view of a road barrier in accordance with a fourth embodiment of the present invention.

Finally, FIG. 5 shows another embodiment of the present invention. The road barrier here is formed as a so-called shoulder barrier which can be placed on shoulders of roads, bridges, etc. The road barrier here has a barrier element 30 and one side element 31 which is connected to the barrier element 30 through angle 32 and bolts 33. A reinforcing element 34 is connected with a side element 31, for example by welding. The left side of the barrier element 30 does not have however the side element so that the shoulder barrier shown in FIG. 1 can be arranged on the shoulders and to occupy very narrow space.

The barriers shown in FIGS. 4 and 5, and in particular all their elements can be formed of metal, for example of corresponding steel and the like.

It will be understood that each of the elements described above, or two or more together, may also find a useful application in other types of constructions differing from the types described above.

While the invention has been illustrated and described as embodied in a road barrier provided therewith, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A road barrier, comprising a barrier element having a lower surface placeable on a roadway, an upper surface vertically spaced from said lower surface, and two side surfaces extending from said lower surface to said upper surface; a hollow attachment element extending upwardly from said barrier element and attached to said barrier element and having two side surfaces and an upper surface connecting said surfaces with one another, said attachment element being attached to said barrier element exclusively in a region located between said lower surface and said upper surface of said barrier element and extending upwardly from said region so as to receive an upper portion of said barrier element and so that said upper surface of said attachment element is vertically upwardly spaced from said upper surface of said barrier element, said side surfaces of said attachment element being inclined so that a cross-section of said attachment element increases from said region to said upper surface of said attachment element, so that when a vehicle hits the road barrier from a side of each of said inclined side surfaces of said attachment element the vehicle runs downwardly along a respective one of said inclined side surfaces of said attachment element and does not run over the road barrier and instead is thrown by said one of said side surfaces of said attachment element back into its lane; and means for connecting said attachment element to said barrier element.

2. A road barrier as defined in claim 1, wherein said downwardly inclined side surfaces are symmetrical relative to a vertical axis of symmetry of the road barrier.

3. A road barrier as defined in claim 1, wherein said barrier element and said attachment element are composed of different materials.

4. A road barrier as defined in claim 3, wherein said barrier element is composed of concrete, wherein said attachment element is composed of metal.

* * * * *